US009033209B2

(12) United States Patent
Fogle et al.

(10) Patent No.: US 9,033,209 B2
(45) Date of Patent: May 19, 2015

(54) CARTON WITH HANDLE

(71) Applicant: Graphic Packaging International, Inc., Atlanta, GA (US)

(72) Inventors: James C. Fogle, Marietta, GA (US); Colin P. Ford, Woodstock, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/093,699

(22) Filed: Dec. 2, 2013

(65) Prior Publication Data

US 2014/0151444 A1 Jun. 5, 2014

Related U.S. Application Data

(60) Provisional application No. 61/797,157, filed on Nov. 30, 2012.

(51) Int. Cl.
*B65D 5/46* (2006.01)
*B65D 5/54* (2006.01)

(52) U.S. Cl.
CPC ..... *B65D 5/46192* (2013.01); *B65D 5/542* (2013.01); *B65D 5/5435* (2013.01)

(58) Field of Classification Search
CPC ..... B65D 5/46192
USPC ..... 229/117.12, 117.13, 117.14, 132, 136, 229/117.22; 206/141, 427
See application file for complete search history.

(56) References Cited

U.S. PATENT DOCUMENTS 1,253,193 A 1/1918 Hill
2,383,183 A 8/1945 Fishcher
2,594,376 A 4/1952 Arneson
2,613,867 A * 10/1952 Darr ..... 229/117.14
2,702,144 A 2/1955 Forrer
2,785,847 A * 3/1957 Forrer ..... 229/117.13
2,797,856 A 7/1957 Jaeschke
2,810,506 A 10/1957 Kessler
2,819,506 A 10/1957 Kessler
(Continued)

FOREIGN PATENT DOCUMENTS

CA 877792 8/1971
CA 2 160 145 9/1995
(Continued)

OTHER PUBLICATIONS

International Search Report and Written Opinion for PCT/2013/072561 dated Mar. 25, 2014.

*Primary Examiner* — Gary Elkins
(74) *Attorney, Agent, or Firm* — Womble Carlyle Sandridge & Rice, LLP

(57) ABSTRACT

A carton for containing a plurality of articles includes a plurality of panels that extend at least partially around an interior of the carton, the plurality of panels comprising a front panel, a back panel, a first side panel, and a second side panel, end flaps respectively foldably connected to respective panels of the plurality of panels, the end flaps comprising a first end flap and a second end flap being at least partially overlapped with respect to one another and thereby at least partially form a closed end of the carton, and a handle formed in at least two of the end flaps, the handle comprising a handle panel in the first end flap for grasping the carton and a handle end portion in the second end flap for directing stress from the handle panel.

31 Claims, 17 Drawing Sheets

FIG. 1

(56) References Cited

U.S. PATENT DOCUMENTS 2,868,433 A 1/1959 Anderson, Jr.
2,955,739 A 10/1960 Collura
2,986,324 A 5/1961 Anderson, Jr.
3,112,856 A 12/1963 MacIntosh et al.
3,127,720 A 4/1964 Gentry et al.
3,204,815 A 9/1965 Weis
3,309,005 A 3/1967 Pilger
3,334,767 A 8/1967 Cornelius et al.
3,355,012 A 11/1967 Weiss
3,371,846 A * 3/1968 Detzel ..... 229/117.22
3,381,881 A 5/1968 Granz et al.
3,828,926 A 8/1974 Rossi
3,886,901 A 6/1975 Zeitter
3,894,681 A 7/1975 Arneson et al.
3,904,036 A 9/1975 Forrer
3,933,303 A 1/1976 Kirby, Jr.
3,951,332 A * 4/1976 Torbeck ..... 229/132
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,195,765 A 4/1980 Roccaforte et al.
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,418,864 A 12/1983 Nielsen
4,424,901 A 1/1984 Lanier
4,436,244 A 3/1984 Morris
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,577,799 A 3/1986 Oliff
4,588,084 A 5/1986 Holley, Jr.
4,653,686 A 3/1987 Wood et al.
4,706,876 A 11/1987 Wilson
4,712,728 A 12/1987 Schuster
4,747,487 A 5/1988 Wood
4,784,266 A 11/1988 Chaussadas
4,784,316 A 11/1988 Crouch
4,802,583 A 2/1989 Calvert et al.
4,816,014 A 3/1989 Bratton et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,392,984 A 2/1995 Yocum
5,395,044 A 3/1995 Stout
5,427,241 A 6/1995 Sutherland
5,458,234 A 10/1995 Harris
5,472,090 A 12/1995 Sutherland
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,070,790 A * 6/2000 Anderson ..... 229/136
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
6,371,365 B1 4/2002 Doucette et al.
6,425,520 B1 7/2002 Peterson
6,523,739 B2 2/2003 Heeley et al.
6,536,656 B2 3/2003 Auclair et al.
6,631,803 B2 10/2003 Rhodes et al.
6,758,337 B2 7/2004 Chargueraud et al.
6,766,940 B2 7/2004 Negelen
6,834,793 B2 12/2004 Sutherland
6,848,573 B2 2/2005 Gould et al.
6,869,009 B2 3/2005 Sutherland et al.
6,899,221 B2 5/2005 Skolik et al.
6,905,066 B2 6/2005 Holley
6,926,193 B2 8/2005 Smalley
6,945,450 B2 9/2005 Rusnock
6,968,992 B2 11/2005 Schuster
7,007,836 B2 3/2006 Smalley
7,234,596 B2 6/2007 Lebras
7,296,731 B2 11/2007 Auclair et al.
7,380,701 B2 6/2008 Fogle et al.
7,416,109 B2 8/2008 Sutherland
7,427,010 B2 9/2008 Sutherland
7,472,791 B2 1/2009 Spivey, Sr.
7,601,111 B2 10/2009 Sutherland et al.
7,699,215 B2 4/2010 Spivey, Sr.
7,743,944 B2 6/2010 Ho Fung et al.
7,743,968 B2 6/2010 Theelen
7,748,603 B2 7/2010 Fogle et al.
7,757,933 B2 7/2010 Dunn
7,793,779 B2 9/2010 Spivey, Sr. et al.
7,806,314 B2 10/2010 Sutherland
8,459,533 B2 6/2013 Requena et al.
8,602,292 B2 12/2013 Brand
2003/0213263 A1 11/2003 Woog
2004/0050917 A1 3/2004 Smalley
2004/0074954 A1 4/2004 Fogle et al.

(56) References Cited

U.S. PATENT DOCUMENTS

| | | | | |
|---|---|---|---|---|
| 2004/0262374 | A1 | 12/2004 | Chargueraud | |
| 2005/0056658 | A1 | 3/2005 | Spivey | |
| 2005/0087592 | A1 | 4/2005 | Schuster | |
| 2005/0167478 | A1 | 8/2005 | Holley, Jr. | |
| 2005/0247767 | A1* | 11/2005 | Smalley | 229/117.13 |
| 2006/0071058 | A1 | 4/2006 | Spivey, Sr. | |
| 2006/0169755 | A1 | 8/2006 | Spivey, Sr. | |
| 2006/0273143 | A1 | 12/2006 | Finch | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0099544 | A1 | 5/2008 | Skolik | |
| 2008/0119344 | A1 | 5/2008 | Sutherland et al. | |
| 2009/0236408 | A1 | 9/2009 | Spivey, Sr. | |
| 2009/0255983 | A1 | 10/2009 | De Paula et al. | |
| 2010/0108747 | A1 | 5/2010 | Brand | |
| 2010/0213249 | A1 | 8/2010 | Requena | |
| 2011/0198393 | A1 | 8/2011 | Bates | |
| 2011/0248078 | A1 | 10/2011 | Holley, Jr. | |
| 2014/0021082 | A1 | 1/2014 | Holley, Jr. | |
| 2014/0224864 | A1* | 8/2014 | Spivey et al. | 229/117.12 |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 2004 018 649 | 4/2005 |
| EP | 341089 | 11/1989 |
| EP | 0 412 226 | 2/1991 |
| EP | 0 473 266 | 3/1992 |
| EP | 1 612 157 | 1/2006 |
| FR | 1 494 239 | 9/1967 |
| FR | 2 579 175 | 9/1986 |
| JP | 8-503187 | 4/1996 |
| JP | 2005-507831 | 3/2005 |
| KR | 20-0356729 | 7/2004 |
| WO | WO 94/10047 | 5/1994 |
| WO | WO 96/27538 | 9/1996 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2007/089282 | 8/2007 |

* cited by examiner

CARTON WITH HANDLE

CROSS-REFERENCE TO RELATED APPLICATIONS

This application claims the benefit of U.S. Provisional Patent Application No. 61/797,157, filed Nov. 30, 2012.

INCORPORATION BY REFERENCE

The disclosure of U.S. Provisional Patent Application No. 61/797,157, which was filed on Nov. 30, 2012, is hereby incorporated by reference as if presented herein in its entirety.

BACKGROUND OF THE DISCLOSURE

The present disclosure generally relates to cartons for holding containers or other types of articles. More specifically, the present disclosure relates to a carton having a handle.

SUMMARY OF THE DISCLOSURE

In general, one aspect of the disclosure is directed to a carton for containing a plurality of articles. The carton includes a plurality of panels that extend at least partially around an interior of the carton. The plurality of panels include a front panel, a back panel, a first side panel, and a second side panel, and end flaps respectively foldably connected to respective panels of the plurality of panels. The end flaps include a first end flap and a second end flap being at least partially overlapped with respect to one another and thereby at least partially form a closed end of the carton. The carton also includes a handle formed in at least two of the end flaps. The handle includes a handle portion in the first end flap for grasping the carton and a handle end panel in the second end flap for directing stress from the handle panel.

In another aspect, the present disclosure is generally directed to a blank for forming a carton. The blank includes a plurality of side panels for forming an interior of the carton formed from the blank, the plurality of panels comprising a front panel, a back panel, a first side panel, and a second side panel, end flaps respectively foldably connected to respective panels of the plurality of panels, the end flaps comprising a first end flap and a second end flap for being at least partially overlapped with respect to one another and thereby at least partially form a closed end of the carton formed from the blank, and handle features formed in at least two of the end flaps, the handle features comprising a handle panel in the first end flap for grasping the carton and a handle end portion in the second end flap.

In another aspect, the present disclosure is generally directed to a method of forming a carton. The method comprises obtaining a blank comprising a plurality of side panels, the plurality of panels comprising a front panel, a back panel, a first side panel, and a second side panel, end flaps respectively foldably connected to respective panels of the plurality of panels, the end flaps comprising a first end flap and a second end flap, and handle features in at least two of the end flaps comprising a handle panel in the first end flap for grasping the carton and a handle end portion in the second end flap. The method comprises folding the plurality of side panels to form an interior of the carton, and forming a handle from the handle features by folding the first end flap and the second end flap to position the handle end portion to direct stress from the handle panel.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers as disposed within the carton embodiments. In this specification, the terms "lower," "bottom," "upper" and "top" indicate orientations determined in relation to fully erected and upright cartons.

Figure 1:
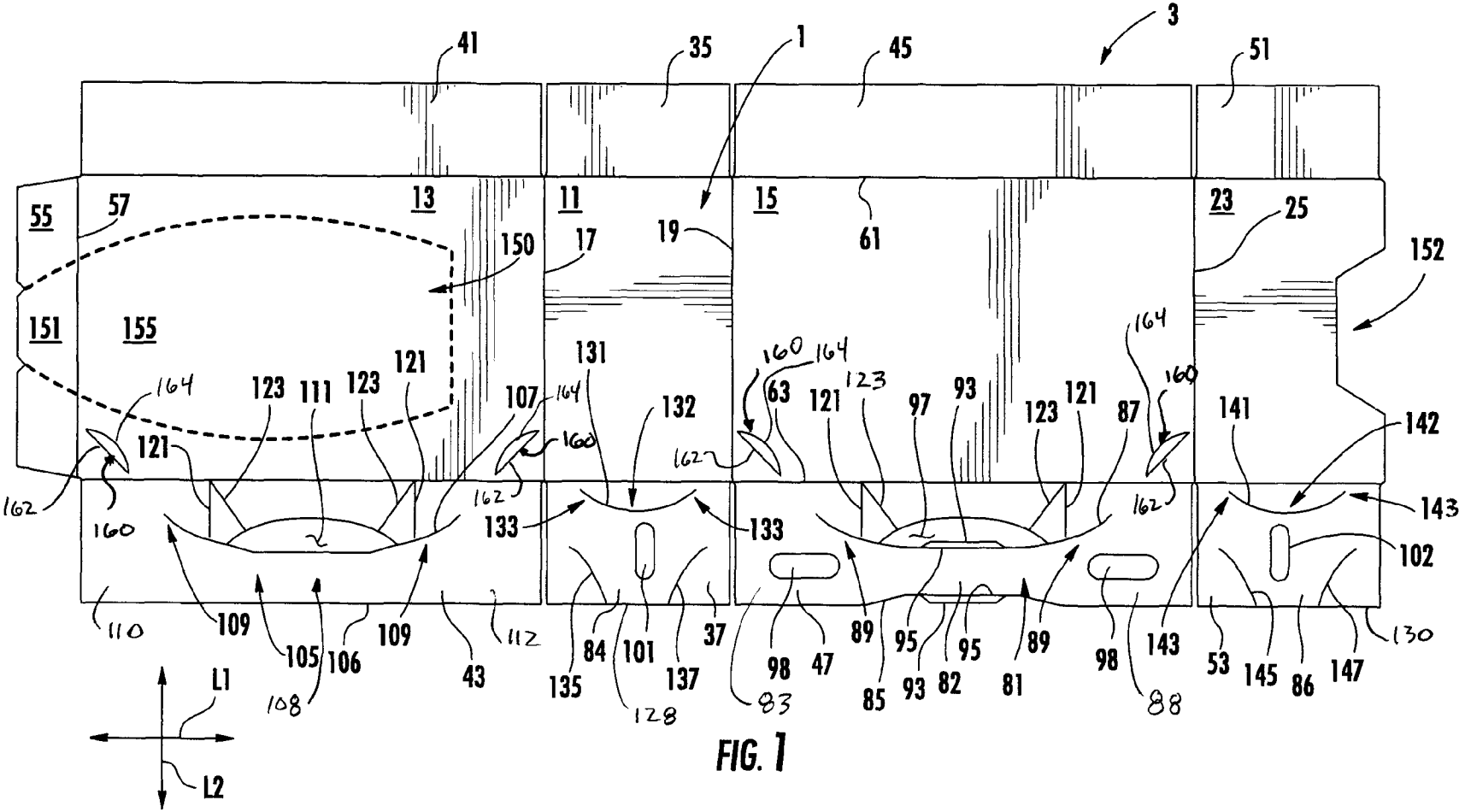
FIG. 1 is a plan view of a blank for forming a carton, according to a first embodiment.

FIG. 1 is a plan view of an exterior surface 1 of a blank 3, used to form a carton 5, shown in FIGS. 8-11, according to one embodiment of the disclosure. The carton 5 can be used to house a plurality of articles such as containers C. In one embodiment, the containers C can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.) without departing form the disclosure.

In one embodiment, the blank 3 is sized to form a carton 5 that contains sixteen containers C or packages in a single layer in a 4×4 arrangement. But, it is understood that the blank 3 and/or carton 5 may be sized and shaped to hold containers C of a different or same quantity in more than one layer and/or in different row/column arrangements (e.g., 1×6, 2×3, 2×6, 2×4, 2×2, 2×6×2, 2×4×2, 2×9, etc.). In the illustrated embodiment, the carton 5 has at least partially closed ends 6, 8 and generally contacts the top and bottom of the group of containers arranged therein. The carton 5 is formed with the containers being loaded into a blank and/or partially formed carton prior to closing one or more ends 6, 8 of the carton. Alternatively, the carton 5 could be a wrap-around carrier with one or more partially open ends without departing from the disclosure.

The carton 5 has a handle 7 that is used for grasping and carrying the carton. The handle 7 is formed by multiple layers of material of the blank 3 so that the handle is strengthened to reduce handle failure, and arranged to flex and extend when grasped to carry the carton to mitigate internal dimensional distortion and direct stress from the middle of the handle to corners of the carton to minimize distortion of the containers C. According to one embodiment of the invention, the handle 7 is formed of at least two (2) layers of material extending between attachment regions on respective end flaps. The attachment regions are adjacent to arcuate cuts configured to allow the handle 7 to extend slightly. The attachment regions may be configured to be fixedly attached to the handle 7 with adhesive or glue. Alternatively, other forms of attachment may be suitable, including locking flaps, tabs, and any other suitable form of attachment.

As shown in FIG. 1, the blank 3 has a longitudinal axis L1 and a lateral axis L2. The blank 3 comprises a first side panel 11 foldably connected to front and back panels 13, 15 at lateral fold lines 17, 19, and a second side panel 23 foldably connected to the front panel 15 at a lateral fold line 25.

The first side panel 11 is foldably connected to a first bottom end flap 35 and a second bottom end flap 37. The front panel 13 is foldably connected to a first side end flap 41 and a second side end flap 43. The back panel 15 is foldably connected to a first side end flap 45 and a second side end flap 47. The second side panel 23 is foldably connected to a first top end flap 51 and a second top end flap 53. The front panel 13 is also foldably connected to top flap 55 at lateral fold line 57. The top flap 55 is configured to at least partially overlap the second side panel 23 in the erected carton 5.

The end flaps 35, 41, 45, 51 extend along a first marginal area of the blank 3, and are foldably connected at a first longitudinal fold line 61 that extends along the length of the blank. The end flaps 37, 43, 47, 53 extend along a second marginal area of the blank 3, and are foldably connected at a second longitudinal fold line 63 that also extends along the length of the blank. The longitudinal fold lines 61, 63 may be, for example, substantially straight according to some embodiments. When the carton 5 is erected, the end flaps 35, 41, 45, 51 close a first end 6 of the carton, and the end flaps 37, 43, 47, 53 close a second end 8 of the carton. In accordance with an alternative embodiment of the present invention, different flap arrangements can be used for closing the ends 6, 8 of the carton 5.

As further shown in FIG. 1, the front panel 13 may include a dispenser 150 arranged thereon. The dispenser 150 may include a distal portion 151 formed in the top flap 55 arranged to at least partially overlap formation 152 formed in the top panel 23 and a portion 153 formed in the side panel 13. Alternatively, other arrangements for the dispenser may be suitable, or the dispenser may be omitted, without departing from the scope of this disclosure.

In one embodiment, the features that comprise the handle 7 include a handle panel 81 that is in the side end flap 47. The handle panel 81 comprises a gripping portion of the handle 7 that includes a central portion 82 and respective end portions 83, 88 in end flap 47. The handle panel 81 is defined by an edge 85 of the blank 3 extending in the longitudinal direction L1 and a cut or tear line 87 spaced apart from the edge 85. The cut 87 includes two arcuate portions 89 extending from an opening 97 in the side end flap 47. The central portion 82 of the handle panel 81 includes two comfort flaps 93 foldably connected to the handle panel 81 at respective lateral fold lines 95. The end portions 83, 88 of the central portion 82 include openings 98 arranged towards the distal ends of the handle panel 81. The handle panel 81 could be otherwise shaped, arranged, and/or configured without departing from the scope of this disclosure.

In the illustrated embodiment, the features that form the handle 7 include a handle panel 105 in the end flap 43. In one embodiment, the handle panel 105 is arranged to overlap the first handle panel 81 when the blank 3 is formed into the carton 5. As shown in FIG. 1, the handle panel 105 comprises a gripping portion of the handle 7 that includes a central portion 108 and two end portions 110, 112 in the end flap 43. The handle panel 105 is defined by an edge 101 of the blank 3 extending in the longitudinal direction L1, a cut or tear line 107 spaced apart from the edge 106, and an opening 111 in the end flap 43. The cut 107 includes two arcuate portions 109 extending from the opening 111 in the side end flap 43. The second handle panel 105 could be otherwise shaped, arranged, and/or configured without departing from the scope of this disclosure.

According to one embodiment, the end flaps 43, 47 may each include lateral cut-crease lines 121 extending from longitudinal fold line 63 towards respective handle panels 81, 105. According to one embodiment, the end flaps 43, 47 may each further include oblique cut-crease lines 123 extending from longitudinal fold line 63 towards respective openings 97, 111. The cut-crease lines 121, 123 could be otherwise shaped, arranged, and/or configured without departing from the scope of this disclosure.

As shown in FIG. 1, the features that form the handle 7 include a handle end portion 84 in the end flap 37 and a handle end portion 86 in the end flap 53. The handle end portions 84, 86 are configured for attachment to handle panels 81, 105 and for directing stress in the carton 5 when the handle 7 is grasped to carry the carton. In one embodiment, the handle end portion 84 comprises a portion of the end flap 37 that is generally defined between a first cut 131 extending generally in the longitudinal direction L1, a second cut 135 extending from an edge 128 of the end flap 37 generally in the lateral direction L2, and a third cut 137 extending from the edge of the end flap generally in the lateral direction. In one embodiment, the cuts 131, 135, 137 are generally curved and/or arcuate, but the cuts could be otherwise shaped, arranged, and/or configured without departing from the disclosure. The cut 131 includes a medial portion 132 and distal portions 133. According to one embodiment, the medial portion 132 is spaced a first distance from the longitudinal fold line 63, and each distal portion 133 is spaced a second distance from the longitudinal fold line 63, and the first distance is greater than the second distance. The handle end portion 84 includes an attachment region 101 in a central portion of the handle end portion. The attachment region 101 can be an embossed or raised portion of the end flap 37 that is configured to receive adhesive. Alternatively, the attachment region 101 could be a debossed region or indentation, or the attachment region could be substantially coplanar with the remaining portion of the end flap 37 without departing from the disclosure.

In the illustrated embodiment, the handle end portion 86 in the end flap 53 is shaped substantially similar to the handle end portion 84 in end flap 37 that has an edge 130. The handle end portion 86 is defined by three cuts 141, 145, 147, and has an attachment region 102. The cut 141 has a medial portion 142 and end portions 143 shaped in a similar manner as the cut 131. Alternatively, blank 3 could have only one handle end portion or one or both of the handle end portions 84, 86 could be otherwise shaped, arranged, and/or configured without departing from the disclosure.

As further shown in FIG. 1, the front and back panels 13, 15 may each include a corner feature 160 for directing stress from the handle 7. In one embodiment, each corner feature 160 includes a straight fold line 162 and a curved fold line 164 extending from respective ends of the straight fold line. The corner features 160 are located proximate a respective corner of the front panel 13 and back panel 15 that is adjacent a respective end flap 43, 47. As shown in FIG. 1, the straight fold line 162 is generally collinear with or generally aligned with curved cuts 89, 109 in the end flaps 343, 47. This arrangement of the straight fold liens 162 assists in directing stress of the handle 7 outwardly and away from the panels 11, 23 in the carton 5 formed from the blank 3. The corner features 160 could be otherwise shaped, arranged, configured, and/or omitted without departing from the disclosure.

An exemplary method of erecting the carton 5 from the blank 3 is discussed in detail below with reference to FIGS. 2-11. At various stages of the erecting process, glue or other adhesive can be applied to the upper or exterior side of a portion of the end flaps 35, 37, 41, 43, 45, 47, 51, 53, and/or top panel 23.

Figure 2:
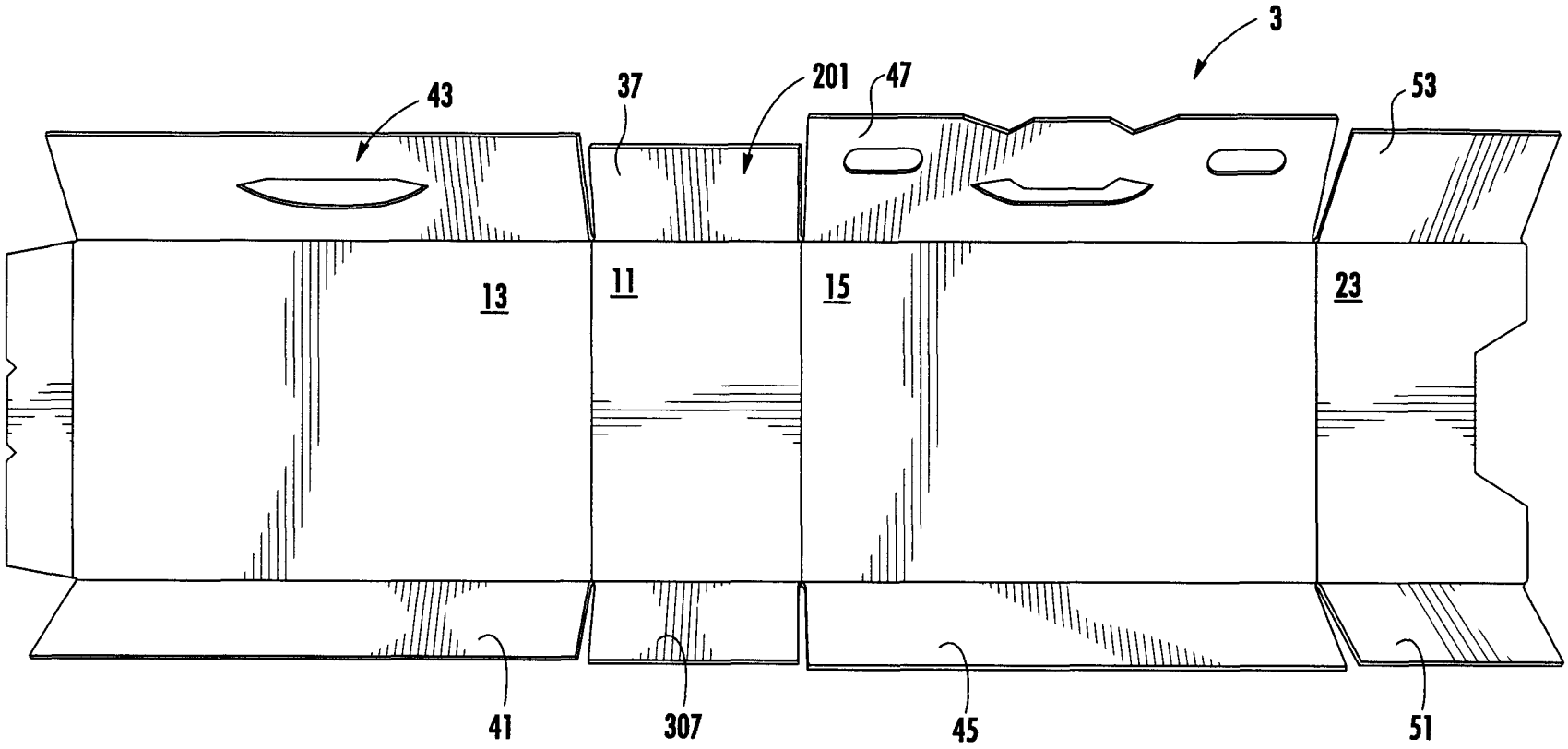
FIG. 2 is a plan view of the blank of FIG. 1.
Figure 3:
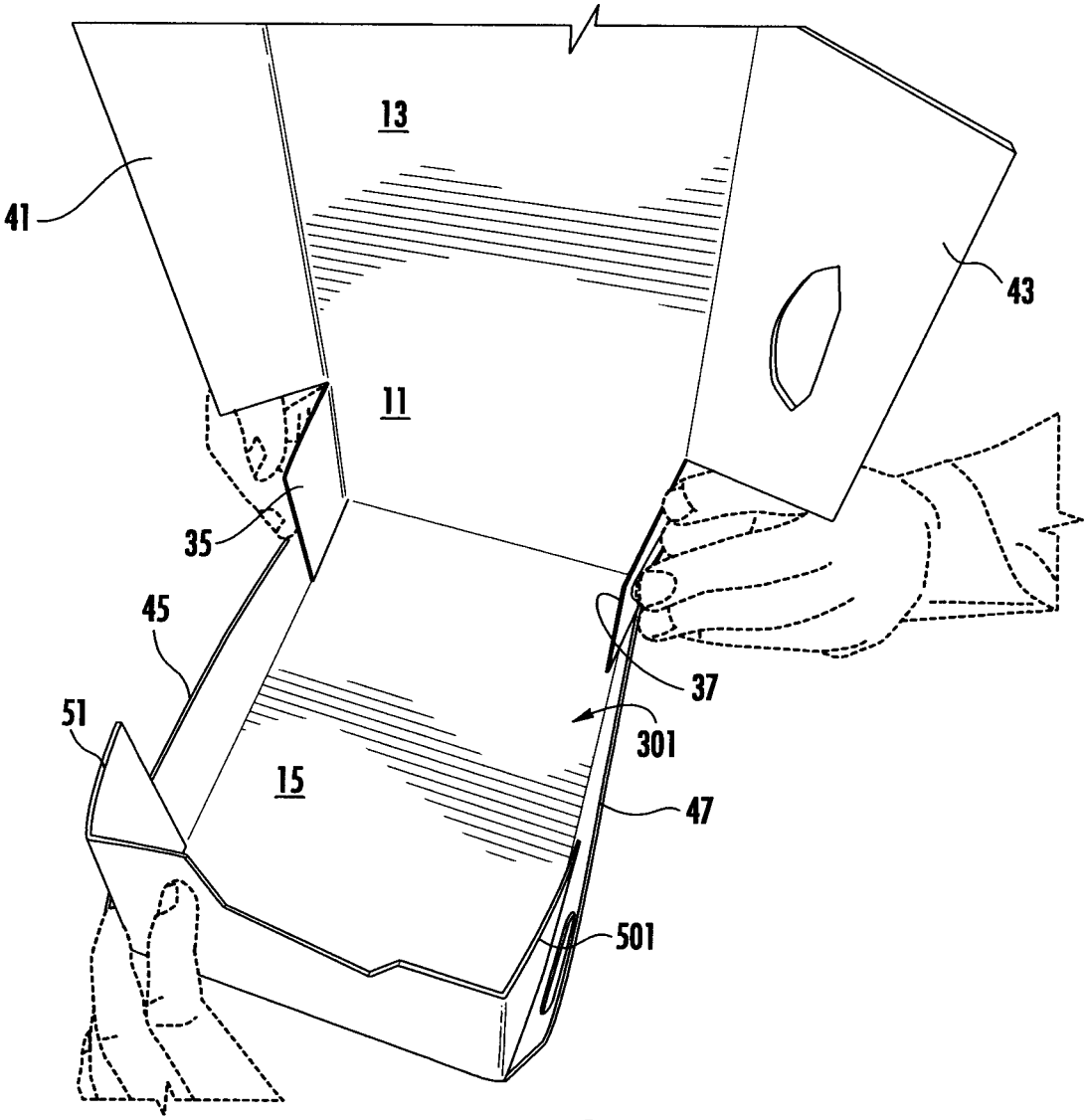
FIG. 3 is a perspective view of a partially assembled carton formed from the blank of FIG. 1.

As shown in FIG. 2, an inner surface 201 of the blank 3 may be arranged to receive one or more containers C. Thereafter, as shown in FIG. 3, panels 11, 13, 15, and 23 and/or flaps 35, 37, 41, 43, 45, 47, 51, and 53 may be folded relative to one another to at least partially form an interior 301 of the carton 5. In one embodiment, the panels 11, 13, 15, 23 form the interior 301 of the carton around a group of containers C, or the panels 11, 13, 15, 23 can form a generally open-ended sleeve with the group of containers C being loaded into the interior 301 of the open-ended sleeve.

As the carton 5 is formed, the handle 7 is formed from the handle features of the blank 3. In one embodiment, the handle 7 is formed by folding the end flaps 37, 43, 47, 53 to at least partially close the second end 8 of the carton. The handle 7 can be formed in the carton 5 prior to folding of the end flaps 35, 31, 45, 51 to close the first end 6 of the carton, or the handle 7 can be formed after the closing of the first end of the carton.

Figure 4:
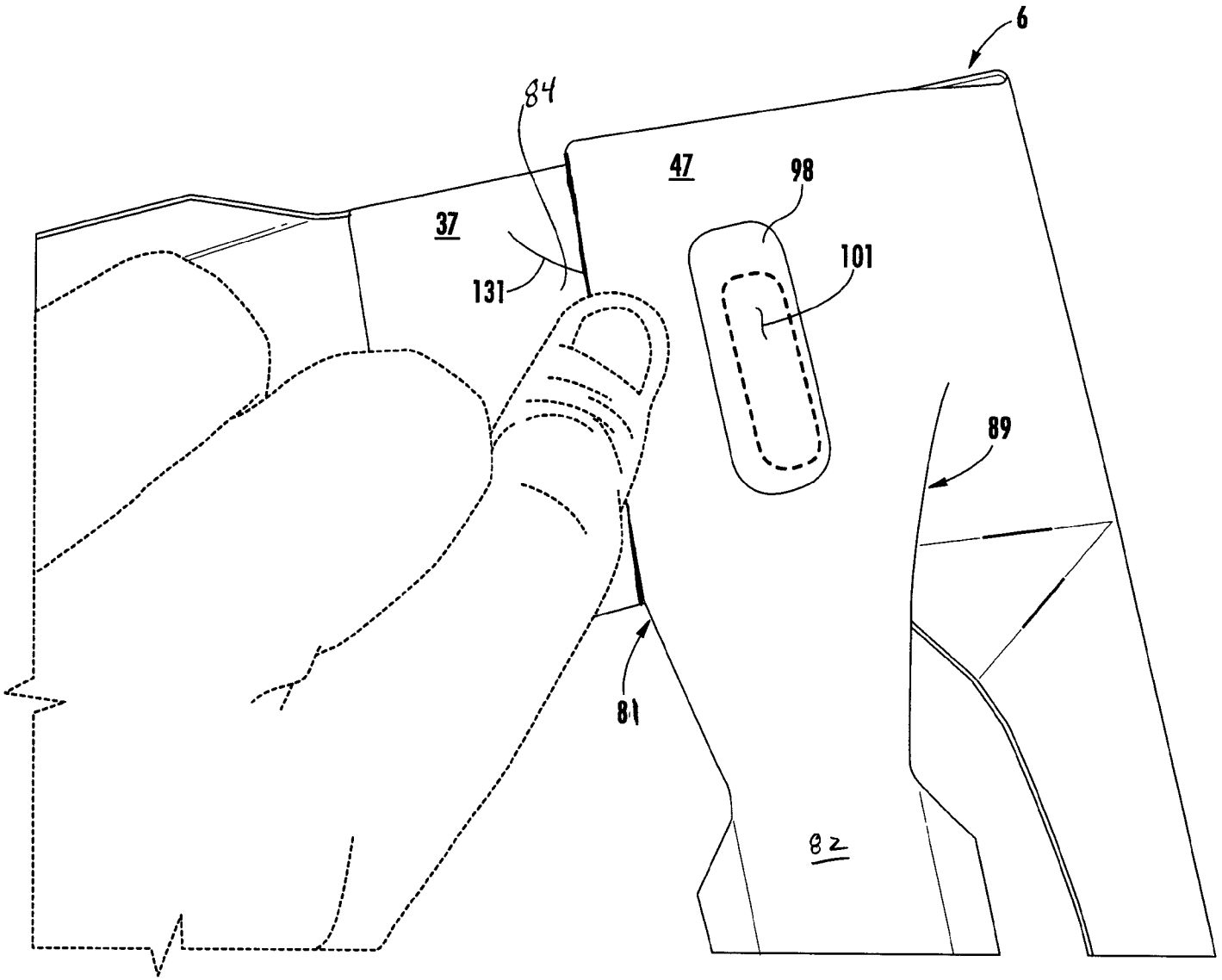
FIG. 4 is an enlarged view of an end portion of an end flap of the blank of FIG. 1.
Figure 5:
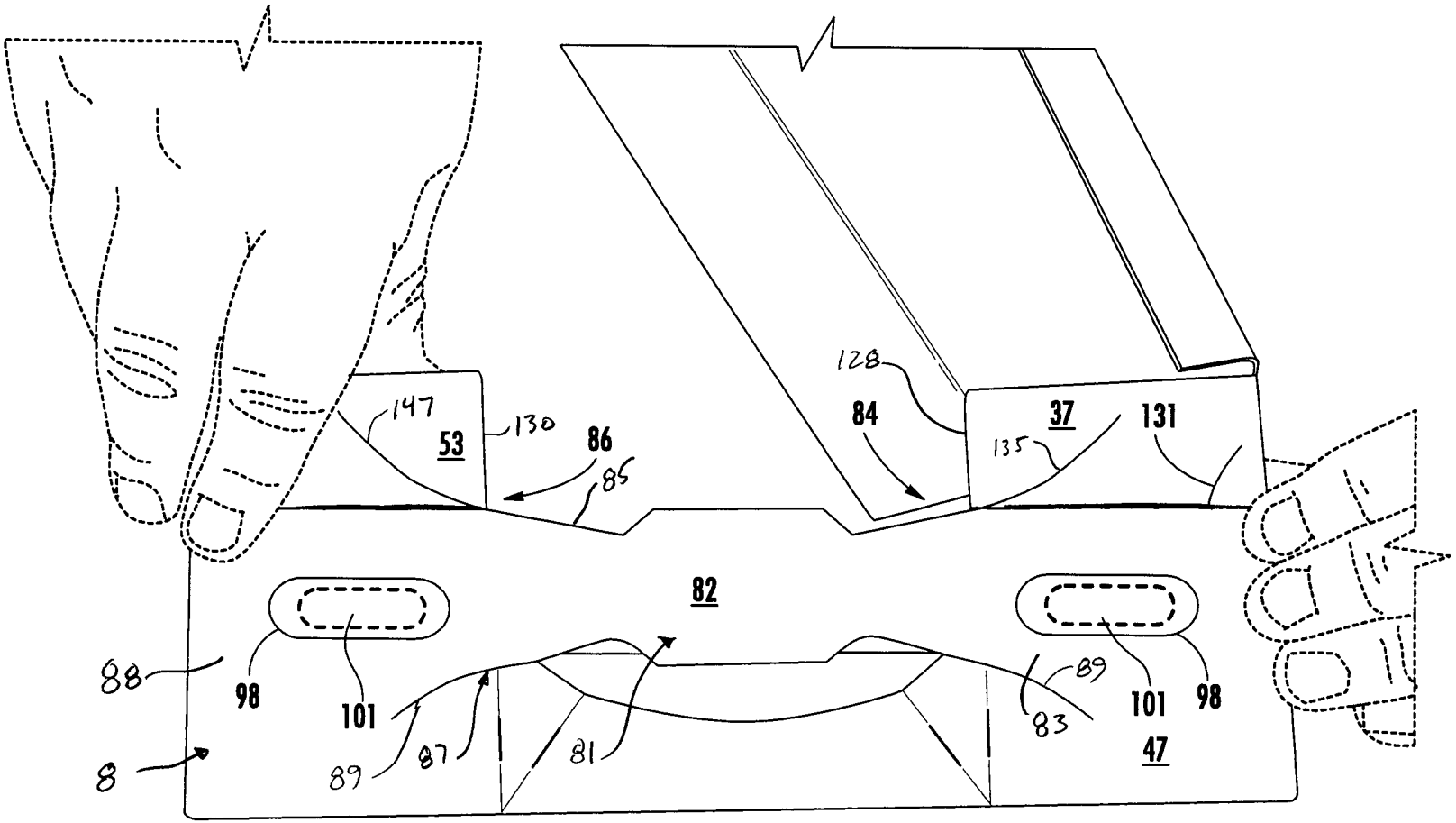
FIG. 5 is a top view of a partially assembled carton formed from the blank of FIG. 1.
Figure 6:
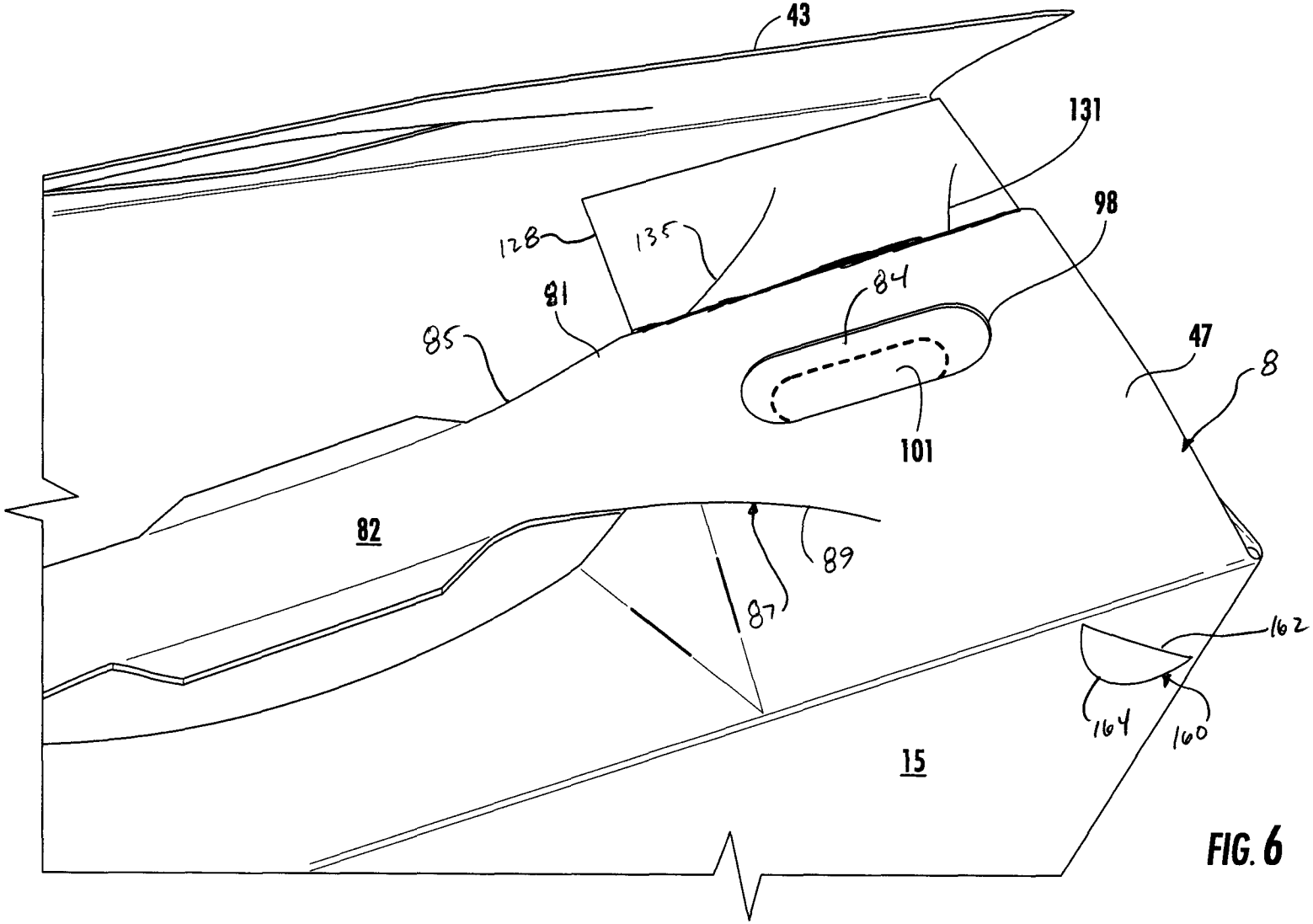
FIG. 6 is a perspective view of a top of a partially assembled carton formed from the blank of FIG. 1.

As shown in FIGS. 4-6, the end flaps 37, 53 with the handle end portions 84, 86 are first inwardly folded to partially close the end 8 of the carton. Next, the end flap 47 with the handle panel 81 is inwardly folded to overlap the end flaps 37, 53. As shown in FIGS. 4 and 5, the handle panel 81 overlaps both the handle end portions 84, 86 and the cut lines 131, 141 (broadly "line of weakening") are positioned generally transverse to the longitudinally extending handle panel 81. The attachment regions 101, 102 are in registration with a respective opening 98 in a respective end portion 83, 88 of the handle panel 81.

Figure 7:
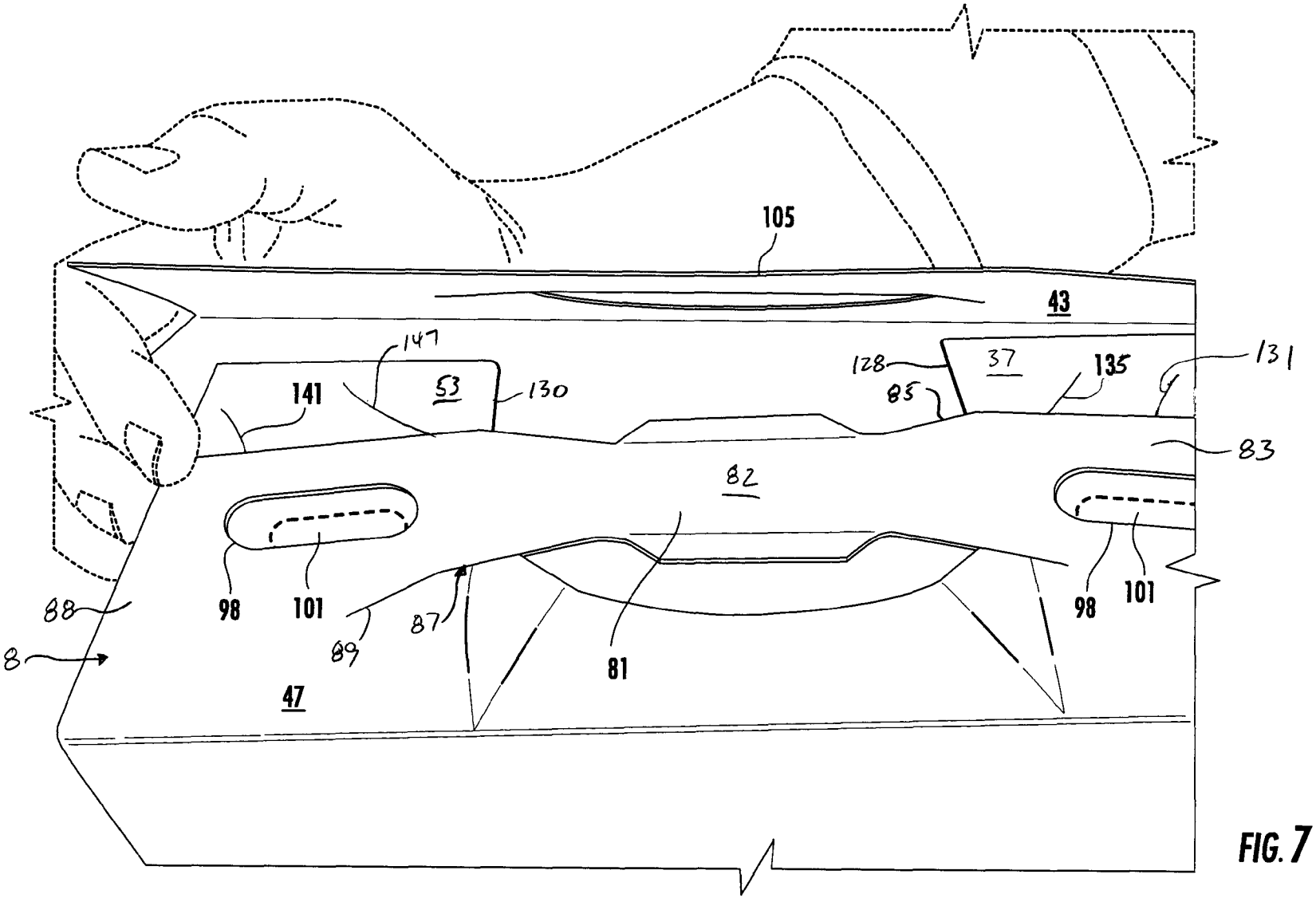
FIG. 7 is a perspective view of a top of a partially assembled carton formed from the blank of FIG. 1.
Figure 8:
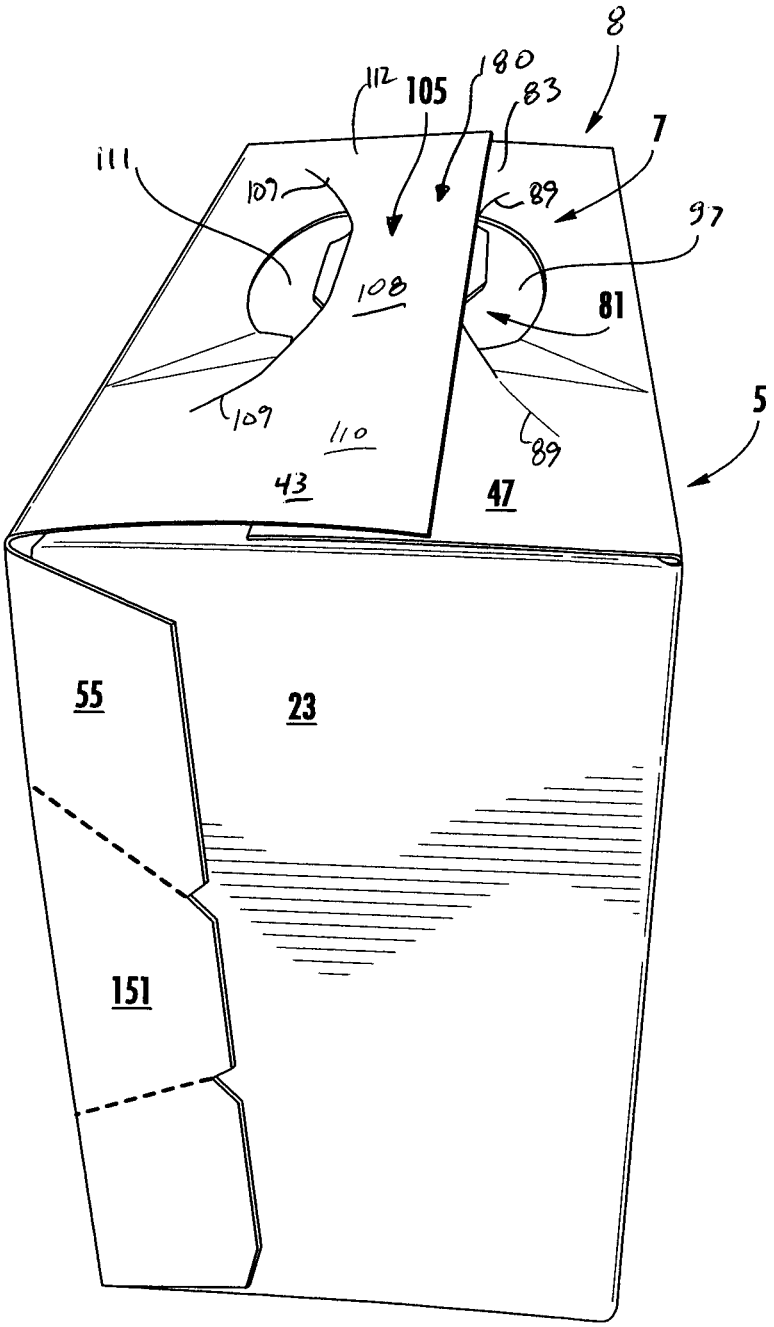
FIG. 8 is a perspective view of a carton formed from the blank of FIG. 1.
Figure 9:
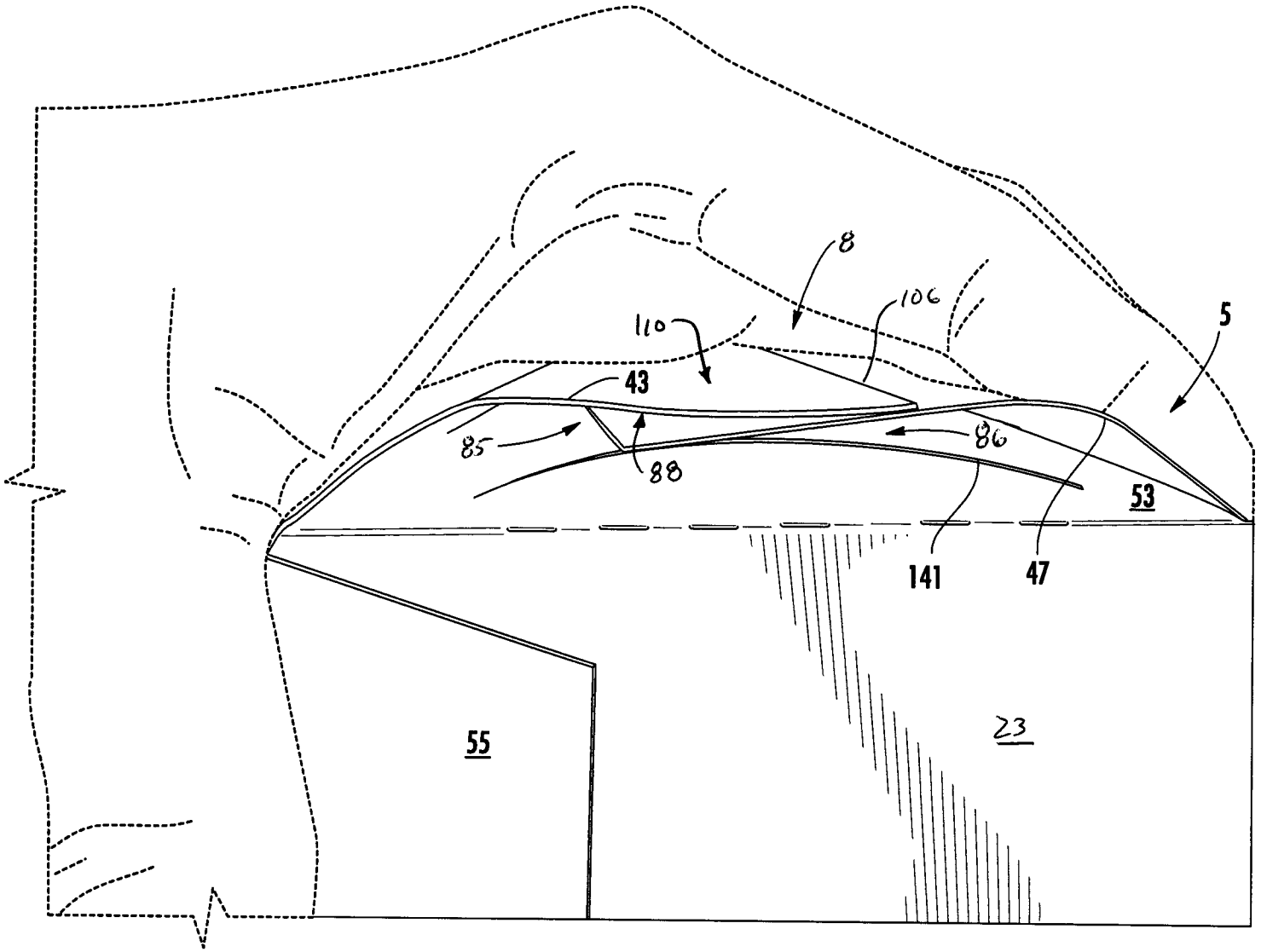
FIG. 9 is an enlarged partial view of an interior of an end portion of a top of the carton of FIG. 8.

As shown in FIGS. 7-8, the end flap 43 with the handle panel 105 is folded to overlap the end flap 47 with handle panel 81, and a portion of the end flap 37 with handle end portion 84, and a portion of the end flap 53 with handle end portion 86. Adhesive applied to the attachment regions 101, 102 of the handle end portions 84, 86 adhesively attaches the handle end portions to the handle panel 105. The handle panel 81 that is overlapped by the handle panel is secured to both handle end portions 84, 86 and the handle panel 105 by being the intermediate layer between the direct adhesive attachments. The handle panel 81, handle panel 105, and handle end portions 84, 86 could be attached together by other methods without departing from the disclosure. The arrangement of the features for forming the handle 7, creates a handle comprising three layers at the ends of the handle corresponding to the overlapped end flaps 53, 47, 43 at one end of the handle and the overlapped end flaps 37, 47, 43 at the other end of the handle. The handle 7 comprises a gripping portion 180 in the end 6 (top) of the carton 5 that comprises the overlapped central portions 82, 108 of the respective handle panels 81, 85 that are adjacent a respective opening 97, 111 to facilitate grasping of the handle. The gripping portion 180 includes relatively narrow central portion corresponding to the overlapped central portions 82, 108 of the handle panels and respective end portions that are wider than the narrow central portion and defined by the overlapped end portions 83, 88, 110, 112 and the handle end portions 84, 86.

Figure 10A:
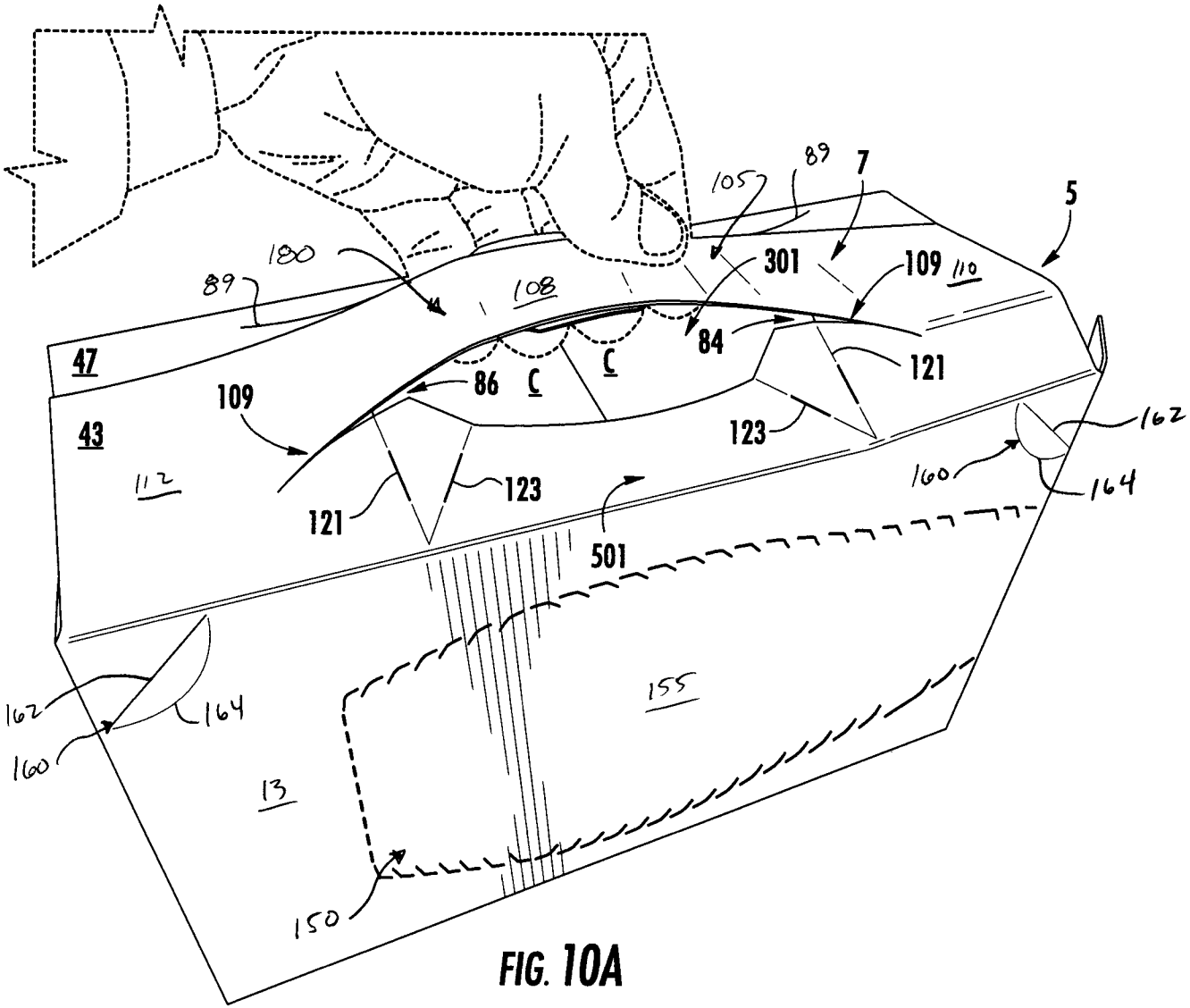
FIG. 10A is a perspective view of a top of the carton of FIG. 8 with force being applied.
Figure 10B:
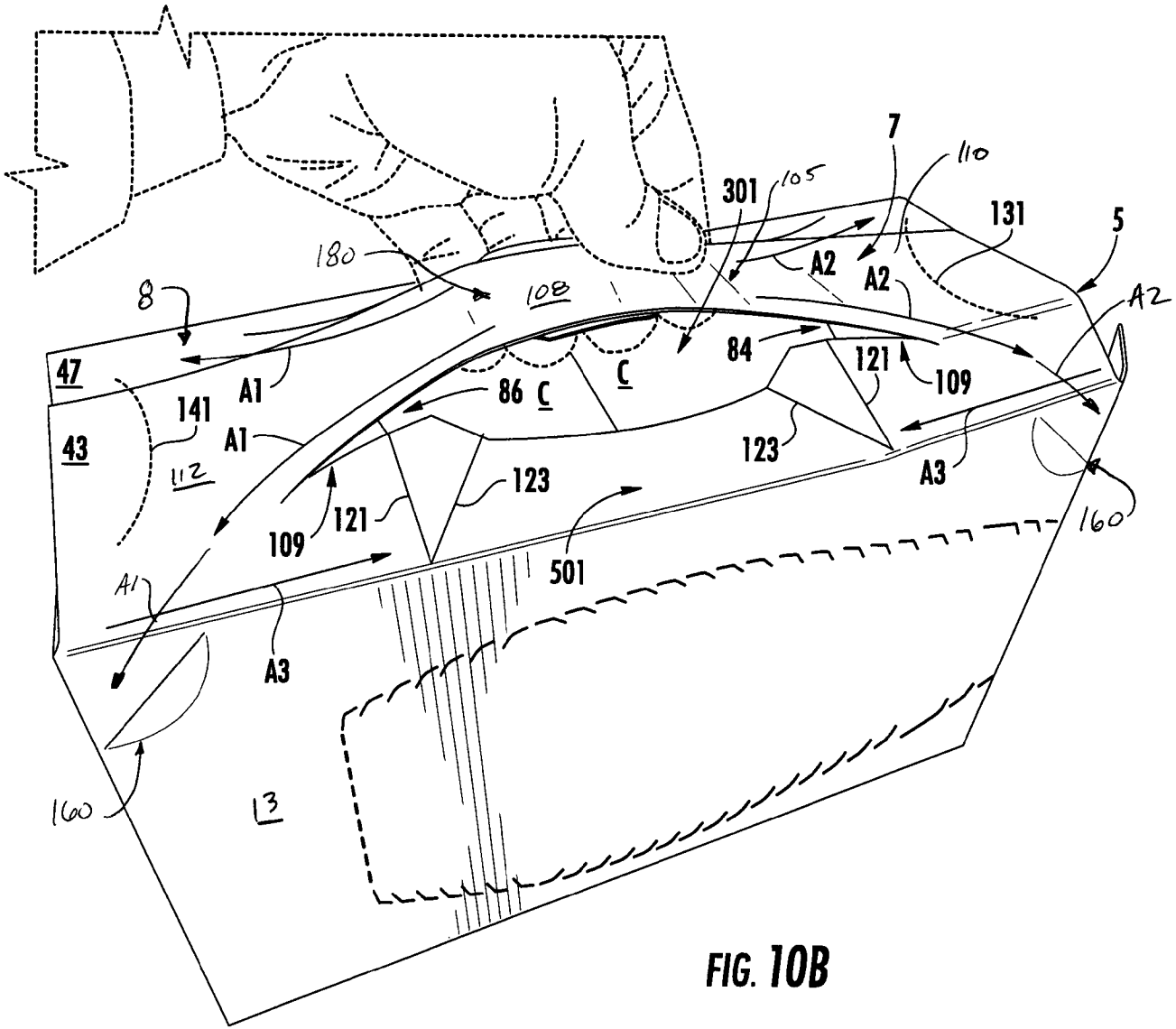
FIG. 10B is a perspective view of the top of the carton of FIG. 8 depicting distribution of forces.
Figure 11:
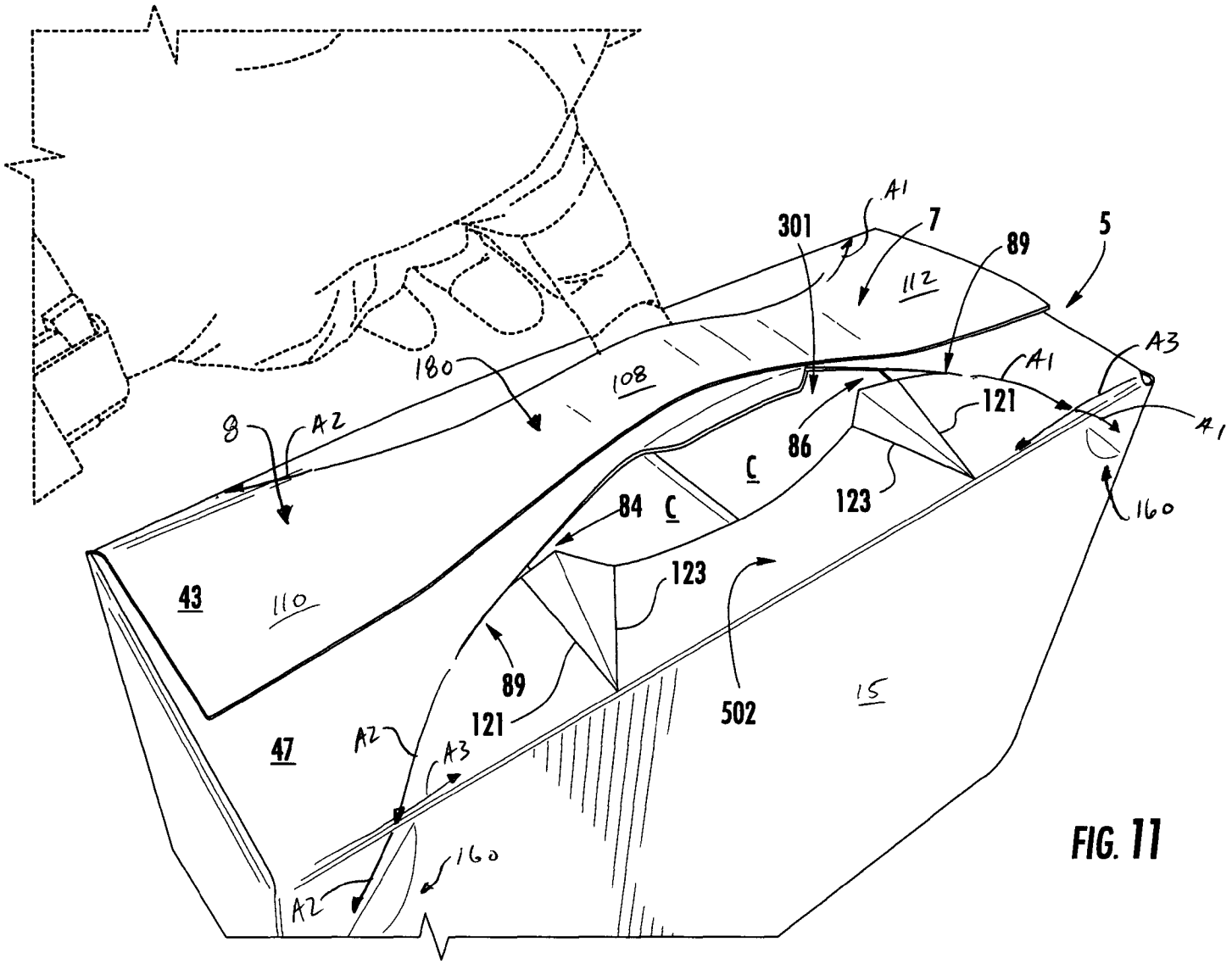
FIG. 11 is an alternative perspective view similar to FIG. 10B on a differing side of the carton of FIG. 8.

As shown in FIGS. 10A-11, the handle features that form the handle 7 direct stress away from the panels 11, 23. The handle 7 can be grasped and a force applied to the gripping portion 180 of the handle 7 so that the handle flexes and extends upwardly as a result of partial separation of the handle from the end flaps 43, 47, 37, 53 at cuts 107, 87, 135, 137, 145, 147 and as a result of flexing of the material of carton 5. As shown in FIG. 10B, when the carton 5 is lifted at the handle 7, a force is applied to the carton corresponding to the weight of the carton that causes stress in the handle. The handle 7 is configured to direct the stress from the lifting force generally towards the corners of the carton 5 in the direction of arrows A2 (FIG. 10B). The cuts 131, 141 in the handle end portions 84, 86 are configured to be generally transverse to the handle gripping portion 180 so that the cuts 131, 141 direct the stress from the handle gripping portion to the corners and generally in the direction of the corner features 160 in the panels 13, 15. The panels 13, 15 are much larger than the panels 11, 23 and can incur the load from the handle with less deformation than the smaller panels 11, 23. Further, the directing of the stress from the handle 7 towards the corners and away from the middle of the closed end 8 of the carton 5 prevents failure in the handle 7 or other portions of the end flaps 37, 43, 47, 53 forming the closed end 8 of the carton. The corner features 160 that are generally aligned with the cuts 107, 87 further assist in distributing the stress in the carton 5 away from the panels 13, 15 to prevent deformation of the carton 5 and damage to the containers C due to lifting at the handle 7. In one embodiment, due to application of force to the handle 7, a portion of flaps 43, 47 denoted as 501, 502 may inflect inwardly towards the interior 301 of the carton 5 about cut crease lines 121, 123, while handle 7 extends outwardly facilitated through arcuate cuts 89, 109, 131, 141. Furthermore, as shown in FIG. 10B, the force applied to lift the handle 7 is redirected by cuts 131, 141 along a direction shown with arrows A1, A2 towards respective corners of the carton 5. A corresponding compression force is created along directions shown with arrows A3 about a perimeter of the carton 5 generally corresponding to fold line 63 connecting the end flaps 37, 43, 47, 53 to a respective panel 11, 13, 15, 23. Direction of the compression force along the fold line 63 corresponds to a location of structural strength of the carton which would be adjacent end portions of the containers C that are stronger than central portions of the containers, thereby limiting, reducing, or mitigating distortion of the containers C during carrying the carton 5 via the handle 7. The handle 7 could have other stress reducing, relieving, directing, or other features to increase the structural strength of the carton 5 without departing from the disclosure.

FIGS. 12-16 are plan views of blanks according to alternative embodiments of the disclosure.

Figure 12:
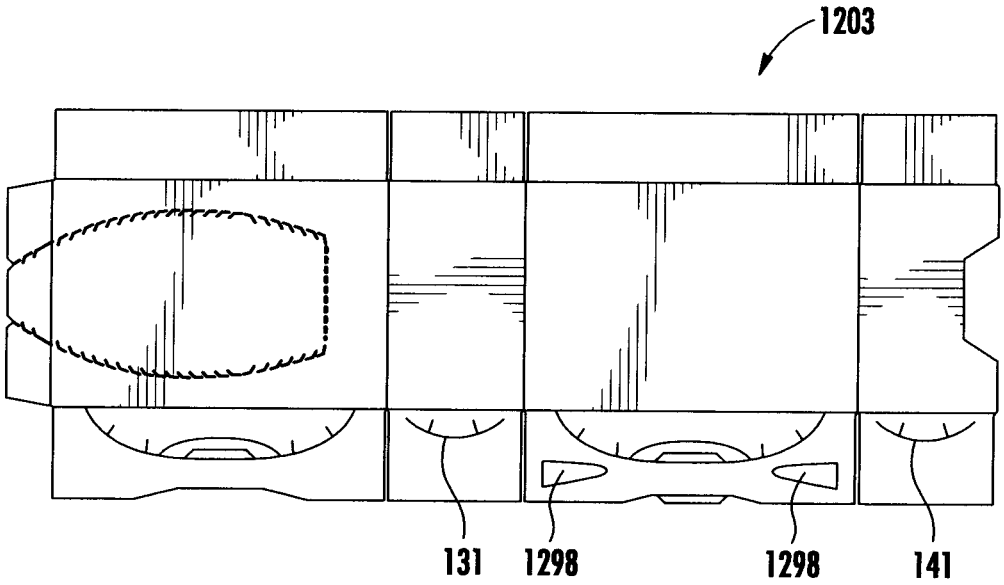
FIGS. 12-16 are plan views of various blanks having features similar to multiple embodiments of the disclosure.

FIG. 12 shows a blank 1203 somewhat similar to blank 3. As shown, the blank 1203 includes arcuate cuts 131, 141, and alternative openings 1298 generally corresponding to openings 98 of the blank 3.

Figure 13:
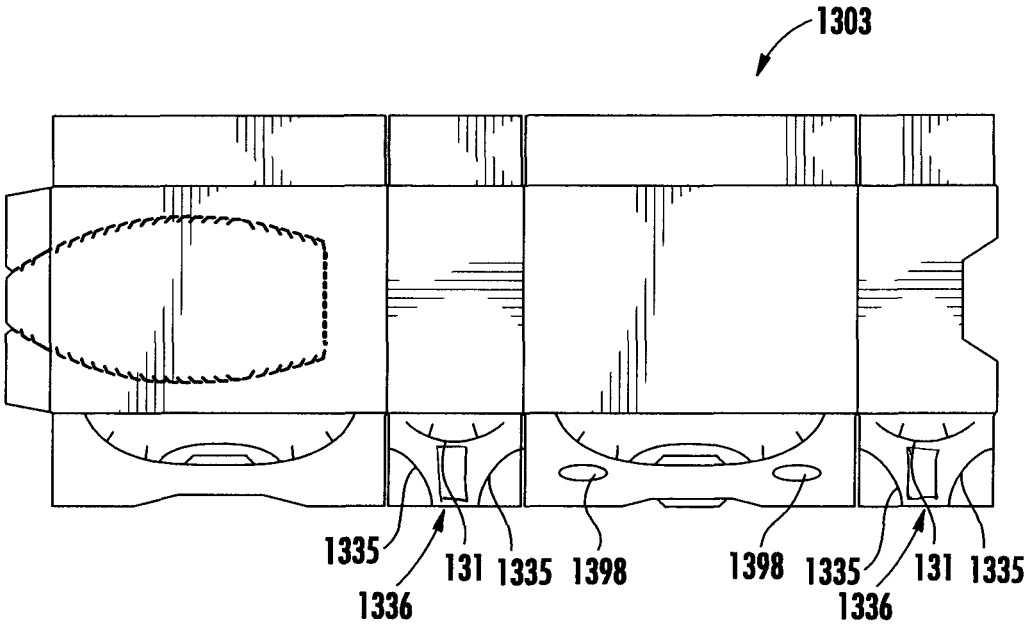

FIG. 13 shows a blank 1303 somewhat similar to blank 3. As shown, the blank 1303 includes arcuate cuts 131, 141, and alternative openings 1398 generally corresponding to openings 98 of the blank 3. Additionally, the blank 1303 includes alternative attachment regions 1336 in a substantially rectangular form arranged between arcuate cut crease lines 1335.

Figure 14:
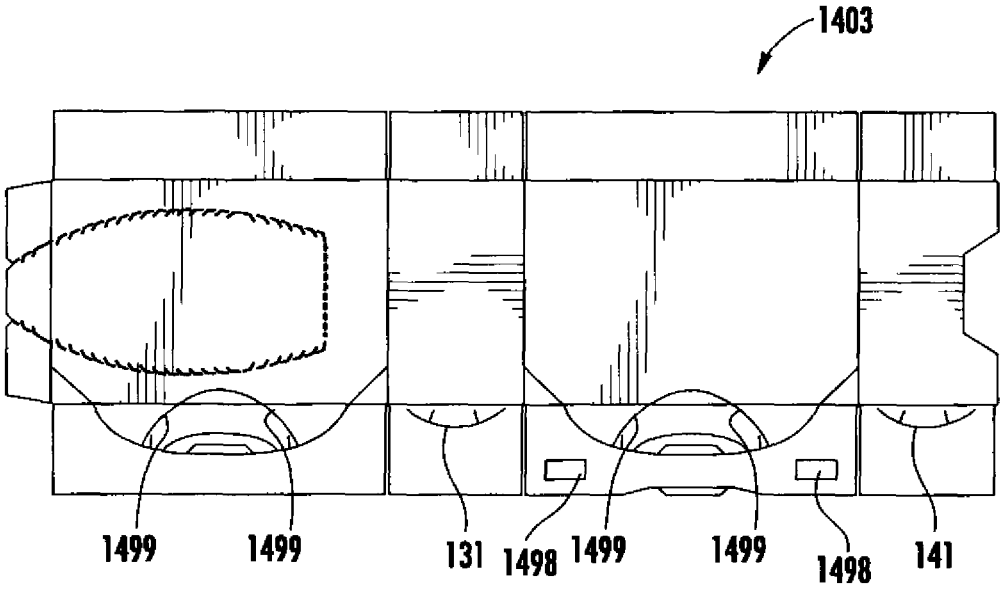

FIG. 14 shows a blank 1403 somewhat similar to blank 3. As shown, the blank 1403 includes arcuate cuts 131, 141, and alternative openings 1498 generally corresponding to openings 98 of the blank 3. Additionally, the blank 1403 includes arcuate fold lines 1499 arranged about respective openings adjacent handle panels. The arcuate fold lines 1499 may aid in deflection of a portion of respective end flaps as noted above.

Figure 15:
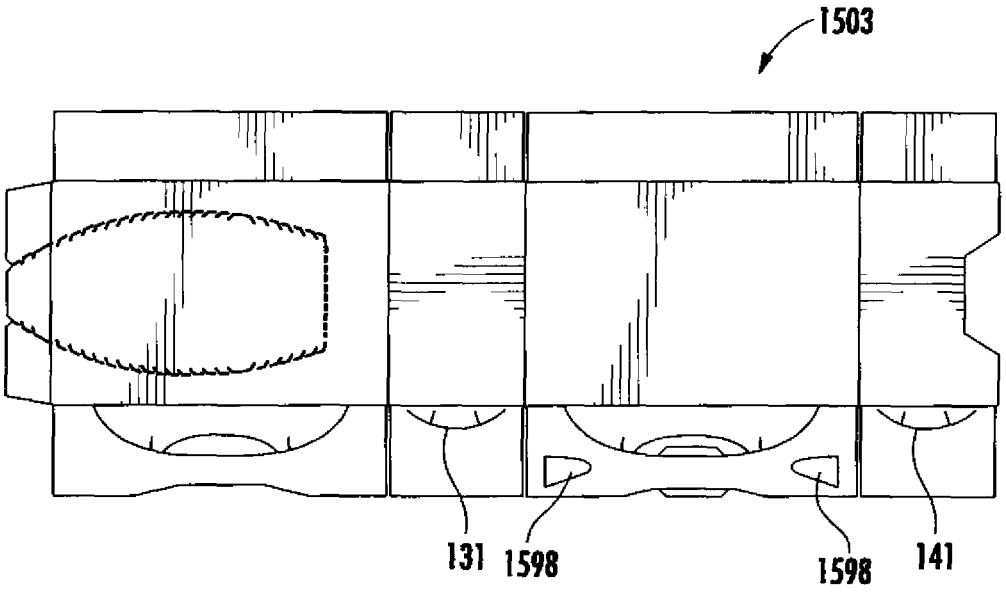

FIG. 15 shows a blank 1503 somewhat similar to blank 3. As shown, the blank 1503 includes arcuate cuts 131, 141, and alternative openings 1598 generally corresponding to openings 98 of the blank 3.

Figure 16:
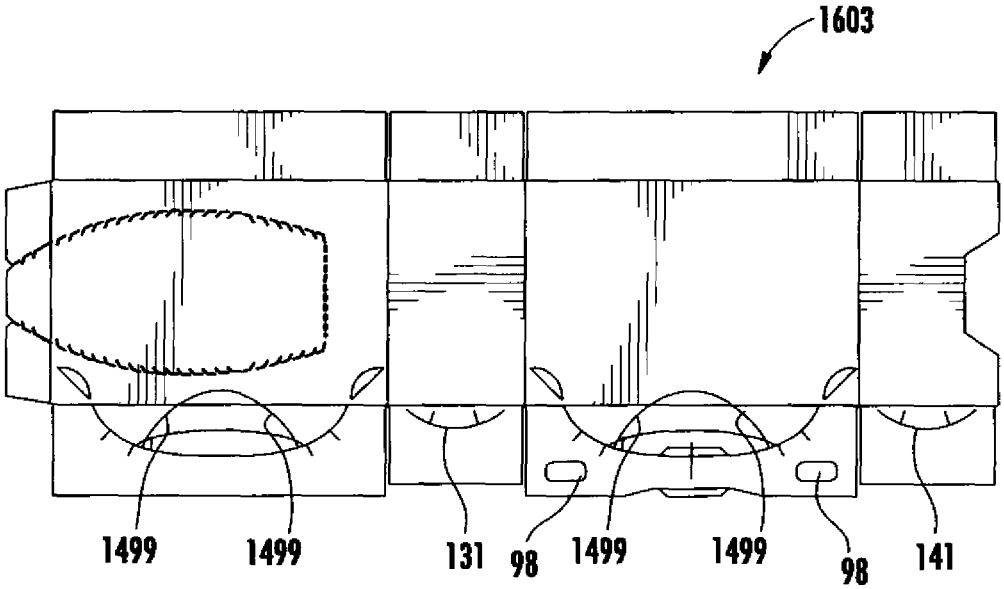

FIG. 16 shows a blank 1603 somewhat similar to blank 3. As shown, the blank 1603 includes arcuate cuts 131, 141 and openings 98. The blank 1603 further includes the arcuate fold lines 1499 described above.

In general, the blanks disclosed herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extend at least partially around an interior of the carton, the plurality of panels comprising a front panel, a back panel, a first side panel, and a second side panel;

end flaps respectively foldably connected to respective panels of the plurality of panels, the end flaps comprising a first end flap and a second end flap being at least partially overlapped with respect to one another and thereby at least partially form a closed end of the carton, the first end flap is foldably connected to one of the front panel and the back panel, and the second end flap is foldably connected to one of the first side panel and the second side panel; and a handle formed in at least two of the end flaps, the handle comprising a handle panel in the first end flap for grasping the carton and a handle end portion in the second end flap for directing stress outwardly and away from the one of the first side panel and the second side panel, the handle panel comprises a gripping portion extending generally along the top of the carton, the handle end portion is defined by a first line of weakening, a second line of weakening, and a third line of weakening, the second line of weakening and the third line of weakening diverge from one another and generally correspond to the shape of the gripping portion, the first line of weakening extends generally transverse to the second line of weakening, the third line of weakening, and the gripping portion.

2. The carton of claim 1, wherein the first line of weakening, the second line of weakening, and the third line of weakening are cuts.

3. The carton of claim 1, wherein the first line of weakening, the second line of weakening, and the third line of weakening are fold lines.

4. The carton of claim 1, wherein the gripping portion is defined by at least one arcuate cut in the first end flap, the gripping portion comprises a narrow central portion defined by the arcuate cut and respective end portions defined by respective end portions of the arcuate cut, the respective end portions of the gripping portion are wider than the narrow central portion.

5. The carton of claim 1 wherein the end flaps comprises a third end flap and a fourth end flap, the handle panel is a first handle portion, and the handle end portion is a first handle end portion, the handle comprises a second handle panel in the third end flap and a second handle end portion in the fourth end flap.

6. The carton of claim 5 wherein the first handle panel and the second handle panel overlap to form an overlapped handle gripping portion of the handle, the first handle end portion is overlapped by the overlapped handle gripping portion and has features for directing stress at a first end of the overlapped handle gripping portion, the second handle end portion is overlapped by the overlapped handle gripping portion and has features for directing stress at a second end of the overlapped handle gripping portion.

7. The carton of claim 6, further comprising an opening in one of the first panel and the second handle panel for adhering the other of the first handle panel and the second handle panel to one of the first handle end portion and the second handle end portion through the opening.

8. The carton of claim 7, wherein the first handle end portion and the second handle end portion comprise an attachment region in registration with the opening.

9. The carton of claim 1, further comprising a corner feature arranged in at least one of the front panel and the back panel for directing stress from the handle.

10. The carton of claim 9, wherein the corner feature comprises a line of weakening.

11. The carton of claim 1, further comprising a dispenser arranged in the front panel.

12. The carton of claim 1, wherein the first line of weakening, second line of weakening, and third line of weakening are curved cuts.

13. The carton of claim 12, wherein the second line of weakening and the third line of weakening extend from an edge of the second end flap.

14. The carton of claim 12, wherein the second end flap is foldably connected to one of the first side panel and the second side panel at a fold line, the first line of weakening has a medial portion and two distal portions, the medial portion is spaced farther from the fold line than the two distal portions.

15. The carton of claim 12, wherein the first line of weakening is spaced apart from the second line of weakening and the third line of weakening.

16. A blank for forming a carton for containing at least one article, the blank comprising:

a plurality of side panels for forming an interior of the carton formed from the blank, the plurality of panels comprising a front panel, a back panel, a first side panel, and a second side panel;

end flaps respectively foldably connected to respective panels of the plurality of panels, the end flaps comprising a first end flap and a second end flap for being at least partially overlapped with respect to one another and thereby at least partially form a closed end of the carton formed from the blank, the first end flap is foldably connected to one of the front panel and the back panel, and the second end flap is foldably connected to one of the first side panel and the second side panel; and handle features formed in at least two of the end flaps, the handle features comprising a handle panel in the first end flap for grasping the carton and a handle end portion in the second end flap, and the handle panel comprises a gripping portion extending generally along the top of the carton formed from the blank, the handle end portion is defined by a first line of weakening, a second line of weakening, and a third line of weakening, the second line of weakening and the third line of weakening diverge from one another and generally correspond to the shape of the gripping portion, the first line of weakening extends generally transverse to the second line of weakening, the third line of weakening, and the gripping portion.

17. The blank of claim 16, wherein the first line of weakening, the second line of weakening, and the third line of weakening are cuts.

18. The blank of claim 16, wherein the first line of weakening, the second line of weakening, and the third line of weakening are fold lines.

19. The blank of claim 16, wherein the gripping portion is defined by at least one arcuate cut in the first end flap, the gripping portion comprises a narrow central portion defined by the arcuate cut and respective end portions defined by respective end portions of the arcuate cut, the respective end portions of the gripping portion are wider than the narrow central portion.

20. The blank of claim 16, wherein the end flaps comprises a third end flap and a fourth end flap, the handle panel is a first handle panel, and the handle end portion is a first handle end portion, the handle comprises a second handle portion in the third end flap and a second handle end panel in the fourth end flap.

21. The blank of claim 20, further comprising an opening in one of the first handle panel and the second handle panel for adhering the other of the first handle panel and the second handle panel to one of the first handle end portion and the second handle end portion through the opening in the carton formed from the blank.

22. The blank of claim 21, wherein the first handle end portion and the second handle end portion comprise an attachment region for registration with the opening in the carton formed from the blank.

23. The blank of claim 16, further comprising a corner feature arranged in at least one of the front panel and the back panel for directing stress from the handle.

24. The blank of claim 23, wherein the corner feature comprises a line of weakening.

25. A method of forming a carton for containing at least one article, the method comprising:

obtaining a blank comprising a plurality of side panels, the plurality of panels comprising a front panel, a back panel, a first side panel, and a second side panel, end flaps respectively foldably connected to respective panels of the plurality of panels, the end flaps comprising a first end flap and a second end flap, the first end flap is foldably connected to one of the front panel and the back panel, and the second end flap is foldably connected to one of the first side panel and the second side panel, handle features in at least two of the end flaps comprising a handle panel in the first end flap for grasping the carton and a handle end portion in the second end flap, the handle panel comprises a gripping portion, and the handle end portion is defined by a first line of weakening, a second line of weakening, and a third line of weakening, the second line of weakening and the third line of weakening diverge from one another and generally correspond to the shape of the gripping portion, the first line of weakening extends generally transverse to the second line of weakening and the third line of weakening;

folding the plurality of side panels to form an interior of the carton; and forming a handle from the handle features by folding and at least partially overlapping the first end flap and the second end flap to position the handle end portion to direct stress from the handle panel, the forming the handle comprises positioning the gripping portion to extend generally along the top of the carton so that the first line of weakening extends generally transverse to the gripping portion and the handle end portion directs stress outwardly and away from the one of the first side panel and the second side panel.

26. The method of claim 25, wherein first line of weakening, the second line of weakening, and the third line of weakening are cuts.

27. The method of claim 25, wherein the first line of weakening, the second line of weakening, and the third line of weakening are fold lines.

28. The method of claim 25, wherein the gripping portion is defined by at least one arcuate cut in the first end flap, the gripping portion comprises a narrow central portion defined by the arcuate cut and respective end portions defined by respective end portions of the arcuate cut, the respective end portions of the gripping portion are wider than the narrow central portion.

29. The method of claim 25, wherein the end flaps comprises a third end flap and a fourth end flap, the handle panel is a first handle panel, and the handle end portion is a first handle end portion, the handle comprises a second handle panel in the third end flap and a second handle end portion in the fourth end flap, and wherein the method further comprises at least partially overlapping the third end flap and the fourth end flap.

30. The method of claim 29, wherein the forming the handle comprises overlapping the first handle panel and the second handle panel to form an overlapped handle gripping portion, overlapping the first handle end portion with the overlapped handle gripping portion, and overlapping the second handle end portion with the overlapped handle gripping portion.

31. The method of claim 30, wherein the blank further comprises an opening in one of the first handle panel and the second handle panel, and wherein the method further comprises adhering the other of the first handle panel and the second handle panel to one of the first handle end portion and the second handle end portion through the opening.

* * * * *